US008038266B2

(12) United States Patent
Sugahara

(10) Patent No.: US 8,038,266 B2
(45) Date of Patent: Oct. 18, 2011

(54) AIR BUBBLE TRAPPING APPARATUS, LIQUID TRANSPORTING APPARATUS, AND INK-JET RECORDING APPARATUS

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 982 days.

(21) Appl. No.: 11/475,864

(22) Filed: Jun. 28, 2006

(65) Prior Publication Data

US 2007/0002108 A1 Jan. 4, 2007

(30) Foreign Application Priority Data

Jun. 29, 2005 (JP) ..... 2005-190495

(51) Int. Cl.
*B41J 2/17* (2006.01)
*B41J 2/175* (2006.01)

(52) U.S. Cl. ..... 347/84; 347/85

(58) Field of Classification Search ..... 347/54, 347/92, 86, 31, 55, 84, 85; 204/562, 671, 204/450, 451; 209/11, 128; 95/70; 435/286.1
See application file for complete search history.

(56) References Cited

U.S. PATENT DOCUMENTS 4,624,764 A * 11/1986 Mintz et al. ..... 204/562
4,874,507 A * 10/1989 Whitlock ..... 209/11
5,310,674 A * 5/1994 Weinreb et al. ..... 435/286.1
5,593,560 A * 1/1997 Inoue ..... 204/671
6,010,201 A 1/2000 Shimoda
6,190,009 B1 2/2001 Kitahara
6,270,212 B1 8/2001 Kusumi et al.
6,332,668 B1 * 12/2001 Ahn ..... 347/54
6,545,815 B2 4/2003 Kroupenkine et al.
6,822,180 B2 * 11/2004 Fujii et al. ..... 209/128
2002/0043463 A1 * 4/2002 Shenderov ..... 204/450
2003/0098901 A1 5/2003 Okuda
2004/0056918 A1 3/2004 Wang et al.
2004/0226819 A1 * 11/2004 Talary et al. ..... 204/451

(Continued)

FOREIGN PATENT DOCUMENTS

JP H03-180355 A 8/1991

(Continued)

OTHER PUBLICATIONS

Japan Patent Office, Notice of Reasons for Rejection for Japanese Patent Application No. 2006-179190 (counterpart to above-captioned patent application), mailed May 10, 2011.

*Primary Examiner* — Stephen Meier
*Assistant Examiner* — Carlos A Martinez
(74) *Attorney, Agent, or Firm* — Baker Botts L.L.P.

(57) ABSTRACT

An air babble trapping apparatus which traps an air bubble in ink includes: a filter having through holes formed in the substrate and an insulating layer with a low wettability formed in a surface of the substrate; and an electric potential control unit which controls an electric potential difference between the electroconductive substrate and the ink. When the electric potential difference is set to be zero, the air bubble in the ink is adhered to a surface of the filter because of the low wettability of the insulating layer. When the electric potential difference is set to be a predetermined value, the air bubble adhered to the surface of the filter is released since the wettability of the surface of the insulating layer of the filter is increased due to an electrowetting phenomenon.

23 Claims, 11 Drawing Sheets

U.S. PATENT DOCUMENTS

| | | | | |
|---|---|---|---|---|
| 2005/0046679 | A1 | 3/2005 | Sanada | |
| 2005/0062816 | A1* | 3/2005 | Yildirim et al. | 347/92 |
| 2005/0219323 | A1* | 10/2005 | Kusakari | 347/55 |
| 2006/0065118 | A1* | 3/2006 | Rosenberg | 95/70 |
| 2007/0195152 | A1 | 8/2007 | Kawai et al. | |

FOREIGN PATENT DOCUMENTS

| | | | |
|---|---|---|---|
| JP | H06-210196 | A | 8/1994 |
| JP | H0764183 | | 3/1995 |
| JP | H08-039829 | A | 2/1996 |
| JP | H10-034955 | A | 2/1998 |
| JP | H11-010904 | A | 1/1999 |
| JP | H11-277751 | A | 10/1999 |
| JP | 2001-150676 | A | 6/2001 |
| JP | 2003-127363 | A | 5/2003 |
| JP | 200458394 | | 6/2003 |
| JP | 2003177219 | | 6/2003 |
| JP | 2005-074634 | A | 3/2004 |
| JP | 2004-114375 | A | 4/2004 |
| JP | 2004114648 | | 4/2004 |
| JP | 2005-067046 | A | 3/2005 |
| JP | 2005-096438 | A | 4/2005 |

* cited by examiner

Fig. 7A
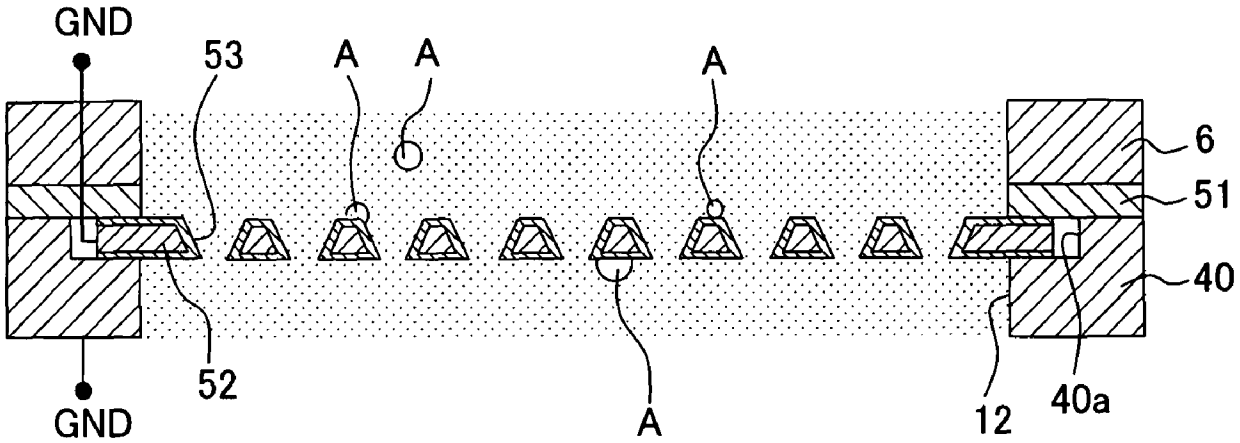
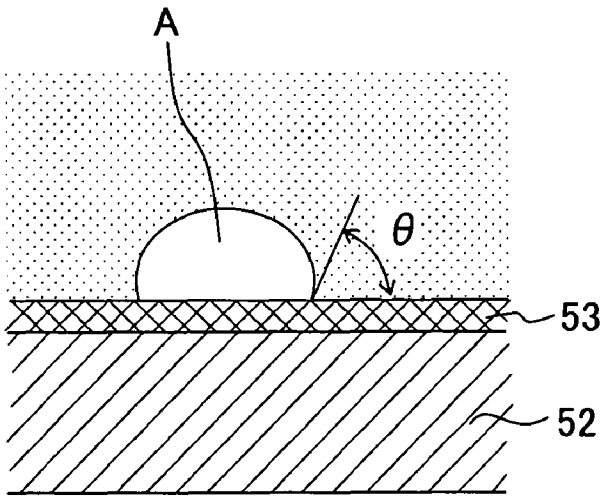
Fig. 7B

AIR BUBBLE TRAPPING APPARATUS, LIQUID TRANSPORTING APPARATUS, AND INK-JET RECORDING APPARATUS

CROSS REFERENCE TO RELATED APPLICATION

The present application claims priority from Japanese Patent Application No. 2005-190495, filed on Jun. 29, 2005, the disclosure of which is incorporated herein by reference in its entirety.

BACKGROUND OF THE INVENTION

1. Field of the Invention

The present invention relates to an air bubble trapping apparatus which traps an air bubble in a liquid, a liquid transporting apparatus which includes the air bubble trapping apparatus and which transports the liquid, and an ink-jet recording apparatus which records an image etc. on a recording medium by discharging ink from a nozzle onto the recording medium.

2. Description of the Related Art

Among ink-jet recording apparatuses in which a pressure is applied to an ink in a pressure chamber which communicates with a nozzle, and an image and/or a character are recorded on a recording medium by discharging the ink from the nozzle onto the recording medium, there are ink-jet recording apparatuses which are provided with a filter for trapping an air bubble and a foreign matter (impurity) entered and mixed in the ink inside an ink channel, for preventing a decline in a recording quality due to a variation in the pressure in the pressure chamber caused by the air bubble entered in the ink, and/or due to a clog-up of the nozzle caused by the foreign matter entered and mixed in the ink. In such ink-jet recording apparatus, the bubble trapped by the filter is discharged out of the apparatus by purging an ink-jet head when the recording is not performed. However, when a wettability of a surface of the filter is low, the air bubble remains on the surface of the filter even after the purging, and there is a fear that the filter is clogged up.

For solving such problem, in an ink-jet recording apparatus shown in FIG. 7 of U.S. Patent Application Publication No. U.S. 2004/056918A1 (corresponds to FIG. 6 of Japanese Patent Application Laid-open No. 2004-114648), a filter is provided in a buffer tank which supplies an ink to a manifold, and the wettability of the surface of the filter is increased by performing a plasma arc machining (plasma processing) on the surface of the filter. Accordingly, the air bubble hardly remains on the surface of the filter, and by purging the ink-jet head, the air bubble can be discharged assuredly.

SUMMARY OF THE INVENTION

However, in the ink-jet recording apparatus described in U.S. Patent Application Publication No. U.S. 2004/056918A1, since the wettability of the surface of the filter is high, an air bubble is hardly adhered also at the time of recording. Accordingly, there is a fear that the air bubble cannot be trapped assuredly at the time of recording.

An object of the present invention is to provide an ink-jet recording apparatus, an air bubble trapping apparatus, and a liquid transporting apparatus which include a filter which can trap assuredly the air bubble on a surface, and remove assuredly the air bubble which is adhered to the surface.

According to a first aspect of the present invention, there is provided an air bubble trapping apparatus which traps an air bubble present (contained) in a liquid flowing through a liquid channel, the air bubble trapping apparatus including:

a filter arranged in the liquid channel and including a substrate having an electroconductive area formed in a surface of the substrate and a plurality of through holes which are formed in the substrate and through which a liquid passes; and an electric potential control mechanism which controls an electric potential of the electroconductive area of the substrate.

According to the first aspect of the present invention, when the electric potential of the electroconductive area is controlled by the electric potential control mechanism such that a difference between the electric potential of the electroconductive area and an electric potential of the liquid is decreased (becomes small), the air bubble in the liquid is trapped assuredly on the surface of the electroconductive area. Therefore, the air bubble is prevented from flowing toward a downstream side of the filter. On the other hand, when the electric potential of the electroconductive area is controlled by the electric-potential control mechanism such that the difference between the electric potential of the electroconductive area and the electric potential of the liquid is increased (becomes great), a phenomenon of electrowetting which will be described later occurs, and the wettability of the electroconductive area is increased (becomes high). As a result of this, the air bubble adhered to the surface of the electroconductive area is removed assuredly. Therefore, a clog-up of the filter due to the air bubble is prevented. Details of the electrowetting phenomenon are described also in U.S. Pat. No. 6,545,815 corresponding to Japanese Patent Application Laid-open No. 2003-177219.

In the air bubble trapping apparatus of the present invention, the filter may further include an insulating layer which covers the electroconductive area of the substrate. Thus, by covering the electroconductive area by the insulating layer having a surface with low wettability (high liquid repellent property), when the difference between the electric potential of the electroconductive area and the electric potential of the liquid is small, the air bubble in the liquid can be made to be adhered assuredly on the surface of the insulating layer. On the other hand, when a predetermined voltage is applied between the electroconductive area and the liquid, due to the electrowetting phenomenon which will be described later, the wettability of a part or portion of the surface of the insulating layer covering the electroconductive area to which the voltage is applied becomes high. Therefore, the adhered air bubble can be released assuredly. Further, by covering the electroconductive area by the insulating layer, when a predetermined voltage is applied between the electroconductive area and the liquid, an electric current flowing between the electroconductive area and the liquid can be reduced. Consequently, power consumption can be suppressed, and the voltage applied to the electroconductive area can be increased.

In the air bubble trapping apparatus of the present invention, the liquid may be an electroconductive liquid which flows in the liquid channel; and the filter may trap the air bubble present in the electroconductive liquid. In this case, since the liquid is electroconductive, the entire liquid can be made to have the same electric potential.

The liquid transporting apparatus of the present invention may include a mode setting unit which is selectively settable to an air bubble trapping mode for trapping the air bubble in the liquid on a surface of the insulating layer of the filter, and an air bubble releasing mode for releasing the air bubble trapped on the surface of the insulating layer of the filter;

wherein the electric potential control mechanism may control the electric potential of the electroconductive area such that a difference between the electric potential of the electroconductive area and an electric potential of the liquid flowing through the liquid channel when the mode setting unit is set to the air bubble trapping mode is smaller than a difference between the electric potential of the electroconductive area and the electric potential of the liquid flowing through liquid channel when the mode setting unit is set to the air bubble releasing mode. Accordingly, by setting the mode setting unit to the air bubble trapping mode, the air bubble in the liquid can be trapped assuredly on the surface of the insulating layer, and by setting the mode setting unit to the air bubble releasing mode, the air bubble in the liquid trapped on the surface of the insulating layer can be released assuredly, thereby removing the air bubble from the surface of the insulating layer.

Further, the liquid transporting apparatus of the present invention may further include a constant potential maintaining mechanism which maintains the electric potential of the liquid flowing through the liquid channel at a predetermined reference electric potential. Accordingly, since the electric potential of the liquid is maintained at a constant reference electric potential all the time, control of the electric potential by the electric potential control mechanism becomes easy.

In the air bubble trapping apparatus of the present invention, the liquid channel may be formed by a channel member which includes an electroconductive material; and the constant potential maintaining mechanism may include a grounding mechanism which grounds the channel member. Accordingly, it is possible to make the electric potential of the liquid to be a ground potential without providing a separate electrode inside the liquid channel. Therefore, the structure of the air bubble trapping apparatus becomes simple.

In the air bubble trapping apparatus of the present invention, the electric potential control mechanism may control the electric potential of the electroconductive area such that a difference between the electric potential of the electroconductive area and the reference electric potential when the mode setting unit is set to the air bubble releasing mode is greater than a difference between the electric potential of the electroconductive area and the reference electric potential when the mode setting unit is set to the air bubble trapping mode. Accordingly, when the mode setting unit is set to the air bubble releasing mode, the wettability of the surface of the insulating layer is higher than the wettability of the surface of the insulating layer when the mode setting unit is set to the air bubble trapping mode. Therefore, the air bubble trapped on the surface of the insulating layer in the air bubble trapping mode can be removed assuredly in the air bubble releasing mode.

Further, in the air bubble trapping apparatus of the present invention, the electric potential control mechanism may control the electric potential of the electroconductive area such that the electric potential of the electroconductive area and the reference electric potential are same when the mode setting unit is set to the air bubble trapping mode, and such that the electric potential of the electroconductive area differs from the reference electric potential when the mode setting unit is set to the air bubble releasing mode. Accordingly, the electric potential control mechanism may perform control such that the electric potential of the electroconductive area is made to be the reference electric potential when the mode setting unit is set to the air bubble trapping mode, and such that the electric potential of the electroconductive area is made to differ from the reference electric potential when the mode setting unit is set to the air bubble releasing mode. Therefore, the control of the electric potential becomes easy.

Furthermore, in the air bubble trapping apparatus of the present invention, the substrate may be formed of a metallic material. Accordingly, the through holes can be formed easily by a method such as an electroforming method and a press method.

In the air bubble trapping apparatus of the present invention, the substrate may include an insulating member in which the through holes are formed; and an electrode which is formed on a surface of the insulating member and which forms the electroconductive area. Accordingly, the through holes can be formed in high precision in the insulating member by a method such as a laser beam machining (laser processing).

In the air bubble trapping apparatus of the present invention, the electrode may be formed on a surface which defines each of the through holes formed in the insulating member. Accordingly, by increasing the potential difference between the electrode and the liquid so as to increase the wettability of the surface, of the insulating member, defining each of the through holes, the air bubble in the liquid trapped on the surface defining each of the through holes can be removed assuredly. Therefore, the clog-up of the through hole by the air bubble can be prevented assuredly.

In the air bubble trapping apparatus of the present invention, the surface of the insulating layer may be flat, and the electrode may be formed on the surface of the insulating member which is flat. Accordingly, since the surface on which the electrode is formed is flat, the electrode can be formed easily.

In the air bubble trapping apparatus of the present invention, a cross-sectional area of each of the through holes may be decreasing toward one side in a direction in which each of the through holes is extended. Accordingly, when the one side in the direction in which each of the through holes is extended is arranged to face the downstream side of the channel, a reverse flow of the liquid from the downstream side of the filter can be reduced.

Further, in the air bubble trapping apparatus of the present invention, the through holes may be formed in the substrate so that the through holes are distributed uniformly in the surface of the substrate. Accordingly, the air bubble can be trapped efficiently on the entire surface of the substrate.

In the air bubble trapping apparatus of the present invention, the insulating layer may be formed of a fluororesin. By covering the electroconductive area of the substrate with the fluororesin, when the voltage is not applied to the electroconductive area, the wettability of the surface of the insulating layer can be lowered sufficiently, and when a predetermined voltage is applied to the electroconductive area, the wettability of the surface of the insulating layer can be raised sufficiently.

According to a second aspect of the present invention, there is provided a liquid transporting apparatus which includes a liquid channel through which a liquid flows; and an air bubble trapping apparatus of the present invention. According to the second aspect of the present invention, it is possible to sufficiently remove an air bubble present in the liquid which is transported by the liquid transporting apparatus. Further, the air bubble which is trapped in a filter of the air bubble trapping apparatus can be released according to the necessity. Therefore, there is no fear that the filter is clogged up by the air bubble.

According to a third aspect of the present invention, there is provided an ink-jet recording apparatus which discharges an ink, including: an ink supply source which supplies the ink; a plurality of ink discharge ports; a common liquid chamber which communicates with the ink discharge ports; a plurality of individual ink channels each of which communicate with the common liquid chamber and one of the ink discharge ports; an energy imparting mechanism which is provided corresponding to each of the individual ink channels and which imparts discharge energy to the ink; an ink supply channel which supplies the ink from the ink supply source to the common liquid chamber; a filter arranged inside the ink supply channel and including a substrate having an electroconductive area formed in a surface of the substrate and a plurality of through holes which are formed in the substrate and through which the ink to passes; and an electric potential control mechanism which controls an electric potential of the electroconductive area of the filter.

According to the third aspect of the present invention, by trapping an air bubble in the ink on a surface of the electroconductive area by decreasing a difference between an electric potential of the electroconductive area and an electric potential of the ink at the time of recording, the air bubble can be prevented from flowing into the individual ink channel(s) and the common liquid chamber, and a variation in an amount of discharge of the ink, and in a speed of discharge of the ink can be reduced. Furthermore, by allowing an electrowetting phenomenon to occur by increasing the difference between the electric potential of the electroconductive area and the electric potential of the ink at the time of purging, the air bubble trapped on the surface of an electroconductive material can be removed. Thus, the bubble can hardly remain on the surface of the electroconductive material after purging, and the clog-up of the filter by the air bubble is prevented.

In the ink-jet recording apparatus of the present invention, the filter may further include an insulating layer which covers the electroconductive area of the substrate. When a layer, of which surface has a low wettability is used as the insulating layer, then when the difference between the electric potential of the electroconductive area and the electric potential of the ink is made to be small, the air bubble in the ink can be trapped assuredly on the surface of the insulating layer. Further, when a predetermined voltage is applied between the electroconductive area and the liquid, due to the electrowetting phenomenon which will be described later, the wettability of a part or portion of the surface of the insulating layer covering the electroconductive area to which the voltage is applied is increased. Therefore, the adhered air bubble can be released assuredly. Furthermore, by covering the electroconductive area by the insulating layer, when a predetermined voltage is applied between the electroconductive area and the liquid, an electric current flowing between the electroconductive area and the liquid can be reduced. Consequently, power consumption can be suppressed, and the voltage applied to the electroconductive area can be increased.

Further, the ink-jet recording apparatus of the present invention may further include a mode setting unit which is selectively settable to an air bubble trapping mode for trapping an air bubble in the ink on a surface of the insulating layer of the filter, and an air bubble releasing mode for releasing the air bubble trapped on the surface of the insulating layer of the filter; and the electric potential control mechanism may control the electric potential of the electroconductive area such that a difference between the electric potential of the electroconductive area and an electric potential of the ink flowing through the ink supply channel, when the mode setting unit is set to the air bubble trapping mode, is smaller than a difference between the electric potential of the electroconductive area and the electric potential of the ink flowing through the ink supply channel when the mode setting unit is set to the air bubble releasing mode. Accordingly, by setting the mode setting unit to the air bubble trapping mode, the air bubble can be trapped in the filter, and by setting the mode setting unit to the air bubble releasing mode, the air bubble trapped in the filter can be removed.

The ink-jet recording apparatus of the present invention may further include: a purge mechanism having a suction unit which sucks the ink and the air bubble, and a cap which covers the ink-discharge ports; and a purge control unit which controls an operation of the purge mechanism; wherein when the purge control unit controls the purge mechanism to perform purge, the mode setting unit may be set to the air bubble releasing mode. Further, when the purge control unit controls the purge mechanism to complete the purge, the mode setting unit may be set to the air bubble trapping mode. Thus, by making the mode setting unit and the purge control unit to operate in conjunction in such a manner, the air bubble adhered to the filter can be removed assuredly when the purge operation is performed, or the air bubble can be let to be adhered assuredly to the filter when the purge operation is not performed.

Further, in the ink-jet recording apparatus of the present invention, a minimum diameter of an inscribed circle accommodable in each of the through holes may be smaller than a diameter of an inscribed circle accommodatable in each of the discharge ports. Accordingly, it is possible to remove assuredly, by the filter, a foreign matter (impurity), an air bubble or the like in the ink and having a size which cannot pass through the ink discharge port, and thus the clog-up of the ink discharge port due to the foreign matter and/or the air bubble can be prevented assuredly.

In the present application, an image includes a figure (graphic), a symbol and a character (letter).

BRIEF DESCRIPTION OF THE DRAWINGS

FIG. 7A is a diagram showing a state when recording is performed in the ink-jet head in FIG. 2, and FIG. 7B is a diagram in which a surface of a filter in FIG. 7A is enlarged;

DETAILED DESCRIPTION OF THE PREFERRED EMBODIMENTS

A preferred embodiment of the present invention will be described below with reference to the drawings. This embodiment is an example in which the present invention is applied to an ink-jet recording apparatus which records an image by discharging an ink from a nozzle onto a recording paper, as a liquid-droplet jetting apparatus.

Figure 1:
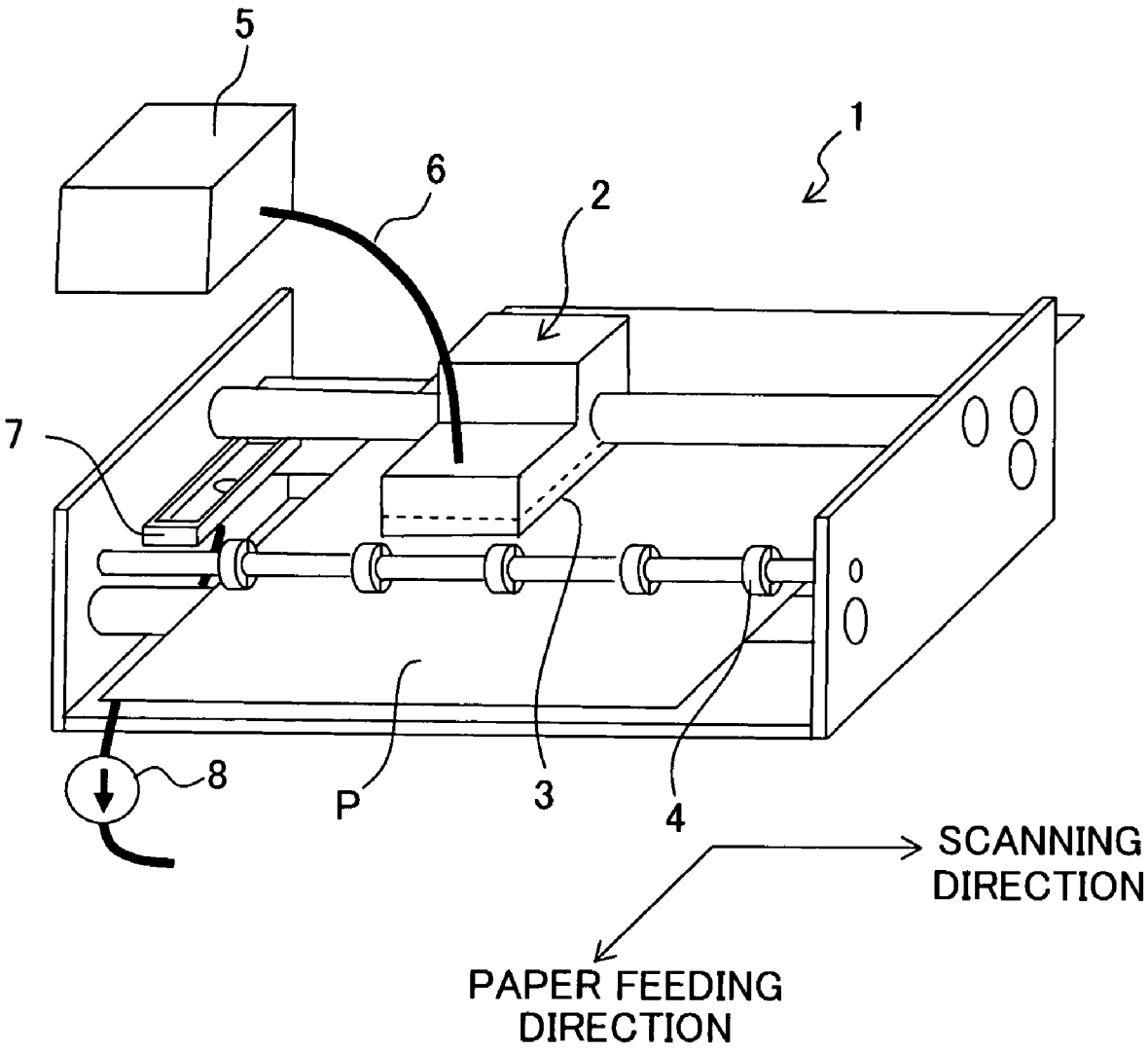
FIG. 1 is a schematic perspective view of an ink-jet apparatus according to an embodiment of the present invention.

As shown in FIG. 1, an ink-jet recording apparatus 1 includes a carriage 2 which is movable in a scanning direction (left and right direction in FIG. 1), an ink-jet head 3 of serial type which is provided on the carriage 2 and discharges ink onto a recording paper P, and transporting rollers 4 which carry (transport) the recording paper P in a paper feeding direction (forward direction in FIG. 1). Ink is supplied to the ink-jet head 3 from an ink tank 5 via a tube 6. Further, the ink-jet head 3, while moving integrally with the carriage 2 in the scanning direction, discharges ink onto the recording paper P from ink discharge ports 17*a* (see FIG. 3) of nozzle 17*s* formed in an ink discharge surface 23*a* (see FIG. 3) on the lower surface of the ink-jet head 3, so as to record an image on the recording paper P. The recording paper P with an image recorded thereon by the ink-jet head 3 is discharged in the paper feeding direction by the transporting rollers 4.

Furthermore, the ink-jet recording apparatus 1 includes a cap 7 which can make a contact with the ink discharge surface 23*a* so as to cover the ink discharge ports 17*a* of the nozzles 17, and a suction pump 8 which sucks the ink from the nozzles 17 in a state that the cap 7 is in contact with the ink discharge surface 23*a*, for discharging the ink forcibly. In the ink-jet recording apparatus 1, when the jetting nozzle or nozzles 17 is (are) clogged due to a foreign matter (impurity) such as dust, or when an air bubble has entered into an ink channel of the ink-jet head 3, and the ink is not discharged in a normal manner from the nozzle 17, the cap 7 is made to have a contact with the ink discharge surface 23*a* and the suction pump 8 is activated to perform a purge, thereby making the ink to be discharged forcibly from the nozzles 17.

Figure 2:
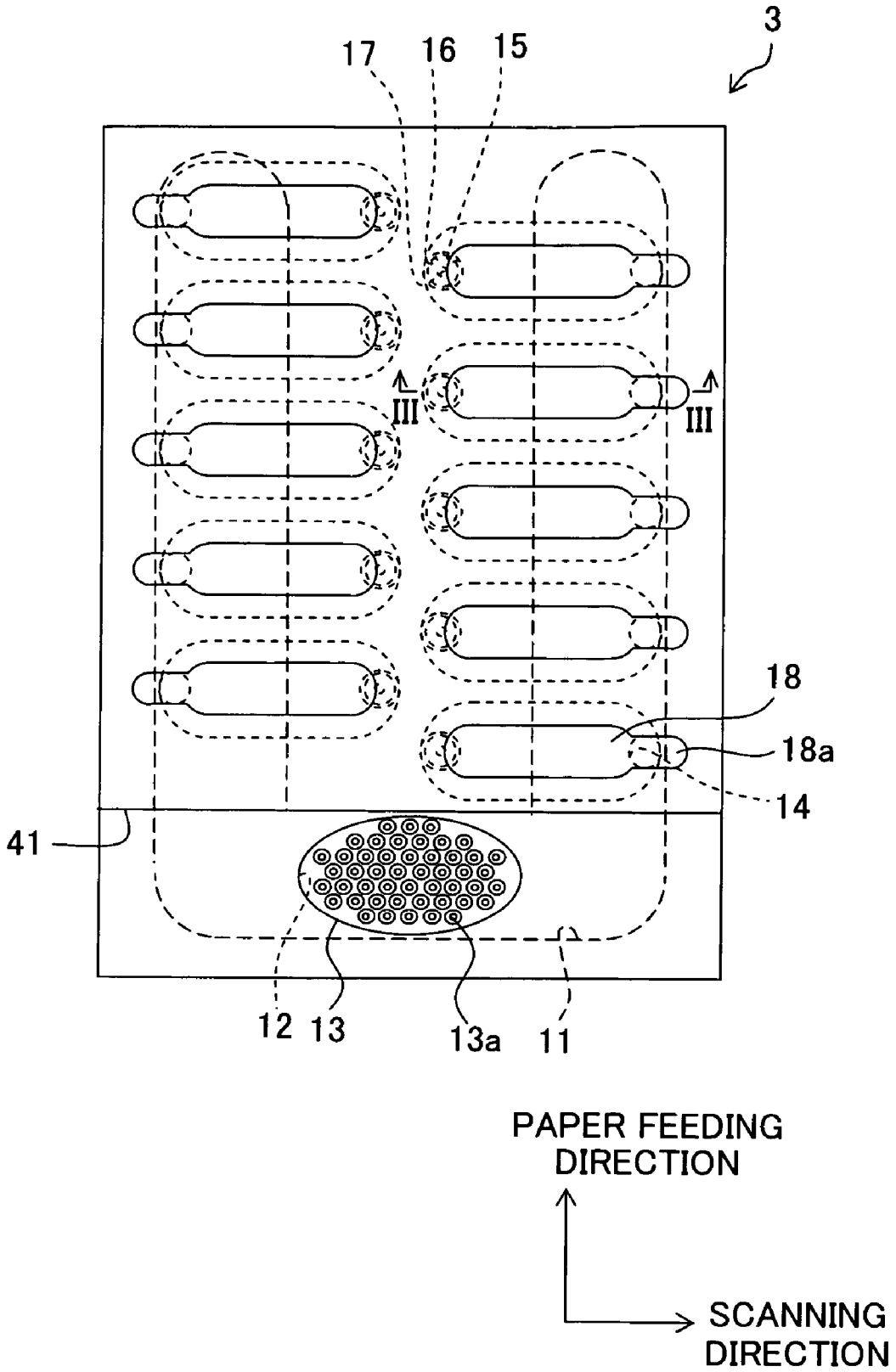
FIG. 2 is a plan view of an ink-jet head in FIG. 1.
Figure 3:
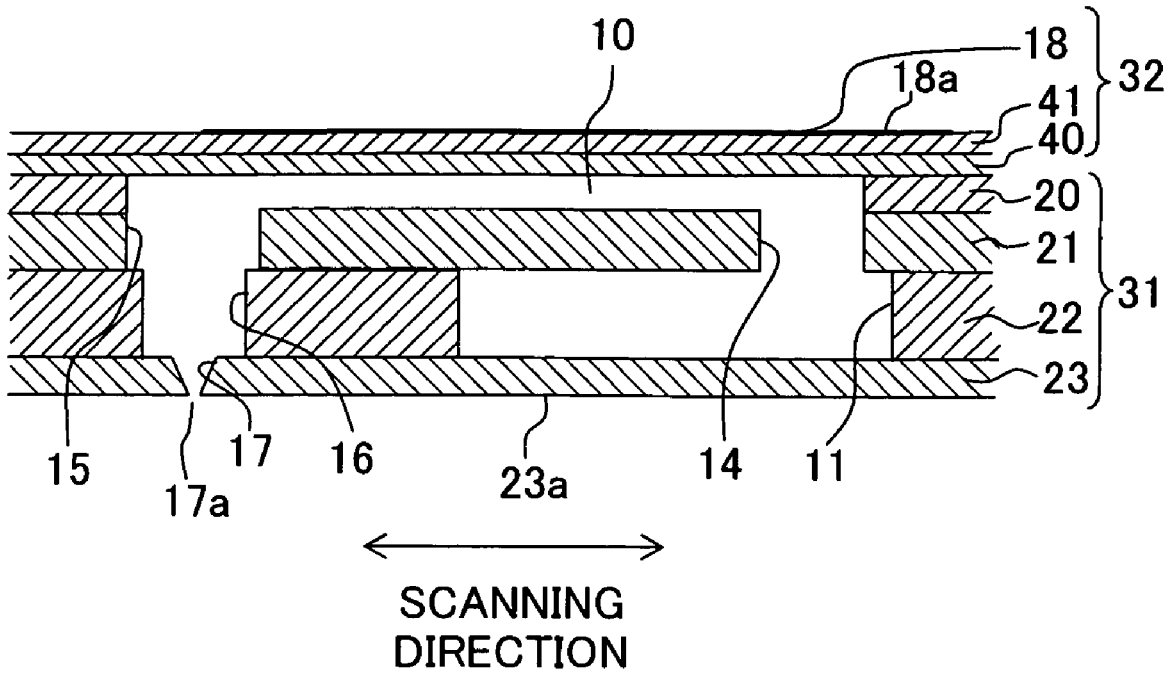
FIG. 3 is a cross-sectional view taken along a line III-III in FIG. 2.

Next, the ink-jet head 3 will be explained in detail by referring to FIGS. 2 and 3. FIG. 2 is a plan view of the ink-jet head 3 in FIG. 1. FIG. 3 is a cross-sectional view taken along a line III-III in FIG. 2. In FIGS. 2 and 3, a driver IC 60 (see FIG. 6) is omitted.

As shown in FIG. 2 and FIG. 3, the ink-jet head 3 includes a channel unit 31 in which individual ink channels each of which includes a pressure chamber 10 is formed, and a piezoelectric actuator 32 which is arranged on the upper surface of the channel unit 31.

As shown in FIGS. 2 and 3, the channel unit 31 includes a cavity plate 20, a base plate 21, a manifold plate 22, and a nozzle plate 23, and these four plates 20 to 23 are joined in stacked layers. Among these four plates, the cavity plate 20, the base plate 21, and the manifold plate 22 are stainless steel plates, and a manifold channel 11 which will be described later, and the ink channel including the pressure chamber 10 are formed in these three plates 20 to 22 by a method such as an etching. Further, the nozzle plate 23 is formed of a high-molecular synthetic resin material such as polyimide, and is joined to the lower surface of the manifold plate 22. Alternatively, the nozzle plate 23 may also be formed of a metallic material such as stainless steel, similar to the three plates 20 to 22.

As shown in FIGS. 2 and 3, in the cavity plate 20, a plurality of pressure chambers 10 (10 pieces of pressure chambers, for example) arranged along a plane are formed, and the pressure chambers 10 are arranged in two rows in the paper feeding direction (up and down direction in FIG. 2). Each of the pressure chambers 10 is formed to be substantially elliptical in a plan view, to be long in the scanning direction (left and right direction in FIG. 2).

Communication holes 14 are formed in the base plate 21 at positions each of which overlaps in a plan view with an end portion of one of the pressure chambers 14, the end portion being on a side of the manifold channel 11 (which will be explained later), and included in both end portions in the longitudinal direction (left and right direction in FIG. 2) of one of the pressure chambers 10. Communication holes 15 are formed in the base plate 21 at positions each of which overlaps in a plan view with the other end portion in the longitudinal direction of one of the pressure chambers 14, the end portion being on a side opposite to the manifold channel 11. Further, the manifold channel 11 which is extended in the paper feeding direction is formed in the manifold plate 22. The manifold channel 11, in FIG. 2, is arranged such that the manifold channel 11 overlaps with left halves of the pressure chambers 10 arranged on the left side and right halves of the pressure chambers 10 arranged on the right side. Furthermore, the manifold channel 11 communicates with an ink supply port 12 formed in a vibration plate 40 which will be described later, and the ink is supplied to the manifold channel 11 from the ink tank 5 (see FIG. 1) via the tube 6 and the ink supply port 12. Communicating holes 16, which communicate with the communication holes 15 respectively, are formed in the manifold plate 22 at positions each of which overlaps in a plan view with the end portion in the longitudinal direction of one of the pressure chamber 10, the end portion being on a side opposite to the manifold channel 11.

The nozzles 17 are formed in the nozzle plate 23 at positions each of which overlaps in a plan view with one of the communicating holes 15. As shown in FIGS. 2 and 3, the nozzles 17 overlap with the end portions of the pressure chambers 10, respectively, the end portions being on the side opposite to the manifold channel 11, and the nozzles 17 are arranged at a substantially central portion of the ink-jet head 3 in the scanning direction, in two rows at equal intervals in the paper feeding direction. Ink discharge ports 17*a* of the nozzles 17, each having a diameter of about 30 μm to 40 μm, are formed in the ink discharge surface 23*a* which is the lower surface of the nozzle plate 23. Each of the discharge port 17*a* is substantially circular in a plan view. When the nozzle plate 23 is made of a synthetic resin material or the like, the nozzles 17 can be formed by a process such as an excimer laser process. Alternatively, when the nozzle plate 23 is made of a metallic material, the nozzles 17 can be formed by a process such as the press working.

Furthermore, as shown in FIG. 3, the manifold channel 11 communicates with each of the pressure chambers 10 via one of the communicating holes 14, and each of the pressure chambers 10 communicates with one of the nozzles 17 via the communicating holes 15, 16. Thus, a plurality of ink channels each from the manifold channel 11 up to one of the nozzles 17 via one of the pressure chambers 10 are formed in the channel unit 31.

Next, the piezoelectric actuator 32 will be explained below. As shown in FIG. 3, the piezoelectric actuator 32 includes the vibration plate 40 which is arranged on the upper surface of the channel unit 31, a piezoelectric layer 41 which is formed on the upper surface of the piezoelectric layer 40, and a plurality of individual electrodes 18 which are formed corresponding to the pressure chambers 10, on the upper surface of the piezoelectric layer 41.

The vibration plate 40 is a plate having roughly rectangular shape in a plan view, and is made of a metallic material such as an iron alloy like stainless steel, a copper alloy, a nickel alloy, or a titanium alloy. The vibration plate 40 is arranged on the upper surface of the cavity plate 20 such that the vibration plate 40 covers the pressure chambers 10, and is joined to the upper surface of the cavity plate 20. Further, the vibration plate 40, made of a metallic material which is electroconductive, is connected to the driver IC 60 (shown in FIG. 6), and is always kept at a ground potential. The vibration plate 40 also serves as a common electrode which makes an electric field to act in the piezoelectric layer 41 sandwiched between the individual electrodes 18 and the vibration plate 40. Furthermore, the ink supply port 12 having a substantially elliptical shape in a plan view is formed in the vibration plate 40. The ink supply port 12 communicates with the manifold channel 11, and the ink is supplied to the manifold channel 11 through the ink supply port 12.

As shown in FIG. 2, the piezoelectric layer 41 which is mainly composed of lead zirconate titanate (PZT) which is a solid solution of lead titanate and lead zirconate, and is a ferroelectric substance is formed on the upper surface of the vibration plate 40 in an area excluding an area in which the ink supply port 12 is formed, and excluding an area extending from the ink supply port 12 in the scanning direction (left and right direction in FIG. 2). As shown in FIGS. 2 and 3, the piezoelectric layer 41 is formed continuously across (over) the pressure chambers 10. Here, the piezoelectric layer 41 can be formed, for example, by using a method such as an aerosol deposition method (AD method) in which very fine particles of a piezoelectric material are blown onto a substrate and collided to the substrate at high velocity, to be deposited onto the substrate. Alternatively, the piezoelectric layer 41 can also be formed, for example, by a method such as a sputtering method, a chemical vapor deposition method (CVD method), a sol-gel method, or a hydrothermal synthesis method. Still alternatively, the piezoelectric layer 41 may also be formed by cutting, to a predetermined size, a piezoelectric sheet which is prepared by baking a green sheet PZT, and sticking the cut piezoelectric sheet or sheets to the vibration plate 40.

The individual electrodes 18 is formed in the upper surface of the piezoelectric layer 41. Each of the individual electrodes 18 has an elliptic shape in a plan view and is smaller in size to some extent than one of the pressure chambers 14. The individual electrodes 18 are formed at positions each of which overlaps in a plan view with a central portion of one of the pressure chambers 14 corresponding thereto. Further, the individual electrodes 18 are made of an electroconductive material such as gold, copper, silver, palladium, platinum, or titanium. Further, a plurality of contact points 18*a* are formed in the individual electrodes 18, respectively. Each of the contact points 18*a* is formed in a portion extending parallel to the longitudinal direction (left and right direction in FIG. 2) of one of the individual electrodes 18, from an end of one of the individual electrodes 18 on a side of the manifold channel 11. These individual electrodes 18 and the contact points 18*a* can be formed by, for example, a screen printing, the sputtering method, a vapor deposition method or the like.

A flexible printed circuit (FPC) board which is not shown in the diagram is joined to the contact points 18*a*, from an upper portion of the piezoelectric layer 41, and the contact points 18*a* are electrically connected to the driver IC 60 (see FIG. 6) via the FPC. Electric potential of the individual electrodes 18 can be selectively controlled by (from) the driver IC 60 via the contact points 18*a*.

Figure 4:
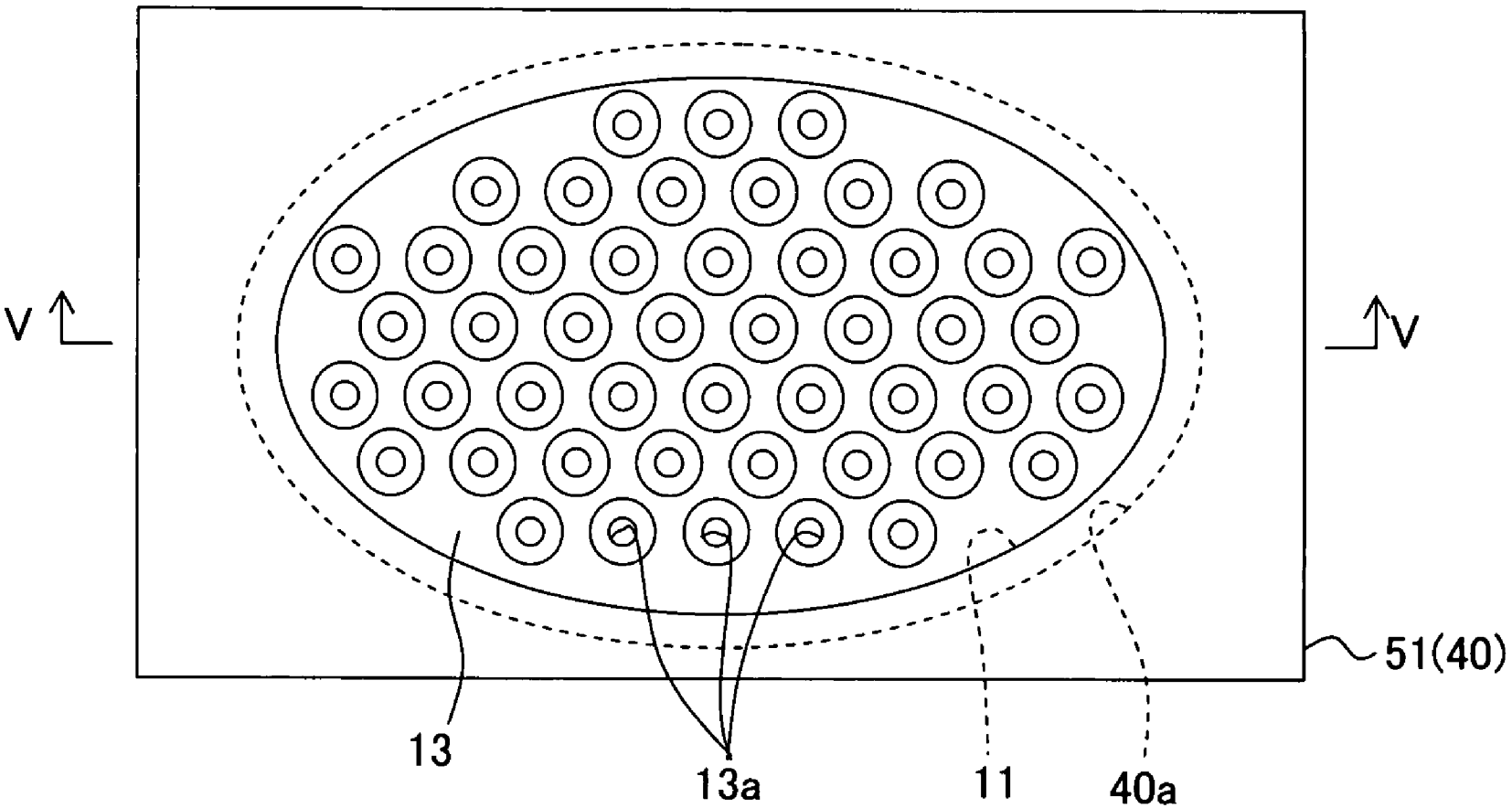
FIG. 4 is an enlarged plan view of an area around an ink supply port in FIG. 2.
Figure 5:
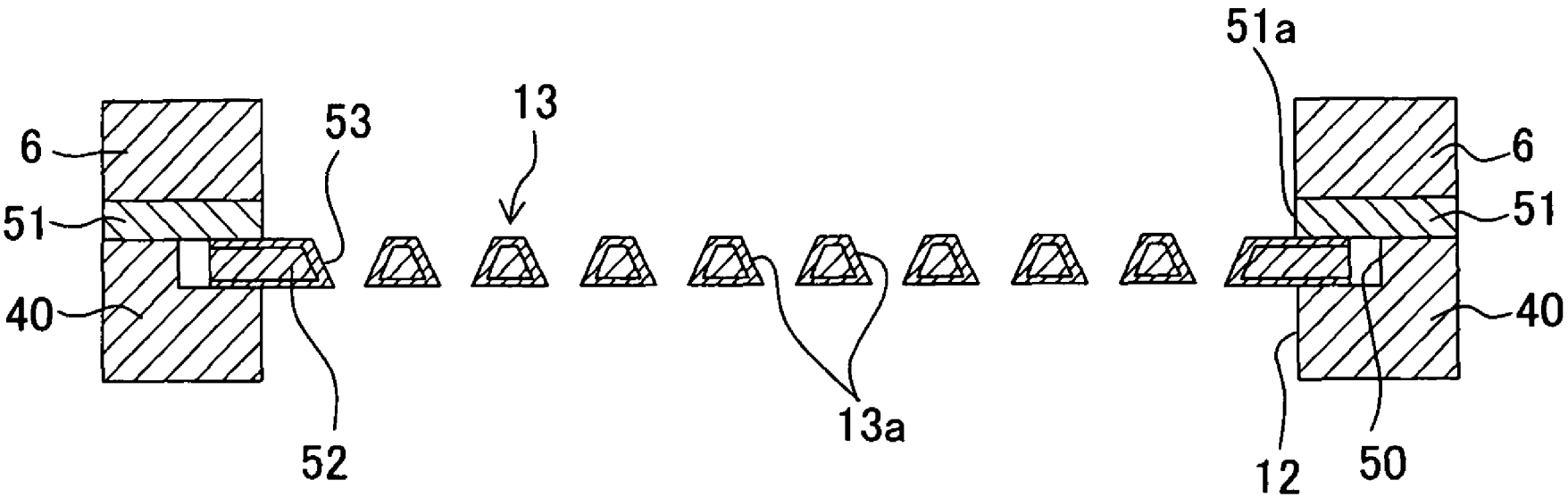
FIG. 5 is a cross-sectional view taken along a line V-V in FIG. 4.

Next, the ink supply channel which communicates with the manifold channel 11 in the ink supply port 12, and which supplies the ink to the manifold channel 11 will be described by using FIGS. 4 and 5. FIG. 4 is an enlarged plan view of an area around the ink supply port 12 in FIG. 2. FIG. 5 is a cross-sectional view taken along a line V-V in FIG. 4. As shown in FIG. 4, the ink supply port 12 having a substantially elliptical shape in a plan view is formed in the vibration plate 40. Further, as shown in FIGS. 4 and 5, a stepped area 50 having a substantially elliptical shape in a plan view, and which is bigger to some extent than the ink supply port 12 in a plan view is formed at a portion, in the upper portion of the vibration plate 40, which surrounds the ink supply port 12. A filter 13 which is a plate having a substantially elliptical shape in a plan view is arranged in the stepped area 50. The filter 13 includes an electroconductive substrate (electroconductive member) 52 in the form of a flat plate which is made of a metal such as nickel; and an insulating layer 53 having surface with a low wettability (high liquid repellent property), such as a fluororesin, the insulating layer 53 being formed on an entire surface of the electroconductive substrate 52. A plurality of through holes 13*a* are formed in an entire surface of the filter 13 such that the through holes 13*a* are distributed uniformly at equal intervals. The through holes 13*a* are formed in a substantially circular shape in a plan view, and a channel area of each of the through holes 13*a* is progressively decreasing (being narrowed) toward a downstream side of a flow of ink, in other words, toward the manifold channel 11, and the minimum diameter of each of the through holes 13*a* is about 8 μm to 10 μm which is smaller than a diameter of each of the ink discharge ports 17*a* of the nozzles 17. The insulating layer 53 is formed of a material having wettability such that an air bubble in the ink which is adhered to the surface of the filter 13 at the time of image recording, in which the ink is discharged from the nozzle 17 (will be described later), is not drawn apart from (separated from) the surface of the filter 13 by the flow of the ink. Such a filter 13 may be manufactured in the following manner. Firstly, the through holes 13*a* are formed in a metal plate made of nickel or the like by a method such as the electroforming and the press working, and the electroconductive substrate 52 is prepared. Next, the insulating layer 53 is formed on an entire surface of the electroconductive substrate 52 by forming a fluororesin layer which is insulative (non-conductive), by a method such as the CVD method.

Further, the electroconductive substrate 52 of the filter 13 is connected to the driver IC 60, and an electric potential of the electroconductive substrate 52 can be controlled by the driver IC 60. The filter 13 and a filter control section (electric potential control mechanism) 64, of the driver IC 60, which is connected to electroconductive substrate 52 of the filter 13 correspond to the air bubble trapping apparatus according to the present invention. The filter control section (electric potential control mechanism) 64 will be described later on.

As shown in FIG. 5, a fixed member 51, in which a communicating hole 51*a* communicating with the ink supply port 12 is formed, is arranged in the upper surface of the vibration plate 40 at a portion facing the ink supply port 12, and the filter 13 is fixed by being sandwiched between the vibration plate 40 and the fixed member 51. The tube 6 communicating with the ink tank 5 is connected to the fixed member 51 on a side opposite to the vibration plate 40. Thus, the ink supply channel communicating with the manifold channel 11 from the ink tank 5 and via the tube 6, the communicating hole 51*a*, the through holes 13*a* of the filter 13, and the ink supply port 12 is formed. The ink in the ink supply channel is in contact with the vibration plate 40 which is kept at the ground potential, and is always kept at the ground potential.

For making the air bubble in the ink to adhere to the filter 13, an electric potential of the electroconductive substrate 52 of the filter 13 is set to the ground potential by using the filter control section 64 which will be described later. At this time, since the surface of the filter 13 is covered by the insulating layer 53 having high liquid repellent property, the air bubble easily adheres to the surface of the filter for the following reason. Because, in general, when the liquid repellent property of a solid surface is high, a state which is energetically stable can be obtained by increasing an area of contact of a gas and a solid, thereby decreasing an area of contact of a liquid and the solid. In other words, this is because, as compared to a case in which the air bubble is not adhered to the surface of the filter 13, a state which is energetically stable can be obtained when the air bubble is adhered to the surface of the filter 13, since an area of a portion of the surface of the filter 13 in contact with the ink is decreased. Therefore, by allowing the electric potential of the electroconductive substrate 52 of the filter 13 and the electric potential of the ink to be same, the air bubble present in the ink can be made to adhere to the surface of the filter 13.

On the other hand, for releasing the air bubble adhered to the surface of the filter 13, the electric potential of the electroconductive substrate 52 of the filter 13 is set to a predetermined electric potential by using the filter control section 64 which will be described later. At this time, due to an electrowetting phenomenon, the liquid repellent property of the insulating layer 53 is lowered. The electrowetting phenomenon is a phenomenon in which, when a voltage is applied between an electrode and an electroconductive liquid in a state that the electrode and the electroconductive liquid are insulated by an insulating film electrically connected to the electrode, a contact angle (wetting angle) between a surface of the insulating film and the liquid becomes smaller as compared to a case in which there is no difference in the electric potential of the electrode and the electric potential of the liquid. In other words, when the voltage is applied between the electrode and the liquid, as compared to the case in which there is no difference in the electric potential of the electrode and the electric potential of the liquid, the liquid repellent property of a surface of the insulating film is lowered.

Thus, when the liquid repellent property of the surface of the filter 13 is lowered, the air bubble is hardly adhered to the surface of the filter 13. This is because, when the liquid repellent property of the solid surface is low, a state which is energetically stable can be obtained by decreasing an area of contact of a gas and a solid, thereby increasing an area of contact of a liquid and the solid. In other words, this is because, as compared to a case in which the air bubble is adhered to the surface of the filter 13, a state which is energetically stable can be obtained when the air bubble is not adhered to the surface of the filter 13, since an area of a portion of the surface of the filter 13 in contact with the ink is decreased. Therefore, by applying a predetermined voltage between the ink and the electroconductive substrate 52 of the filter 13, the air bubble in the ink adhered to the surface of the filter 13 can be released from the surface of the filter 13.

Figure 6:
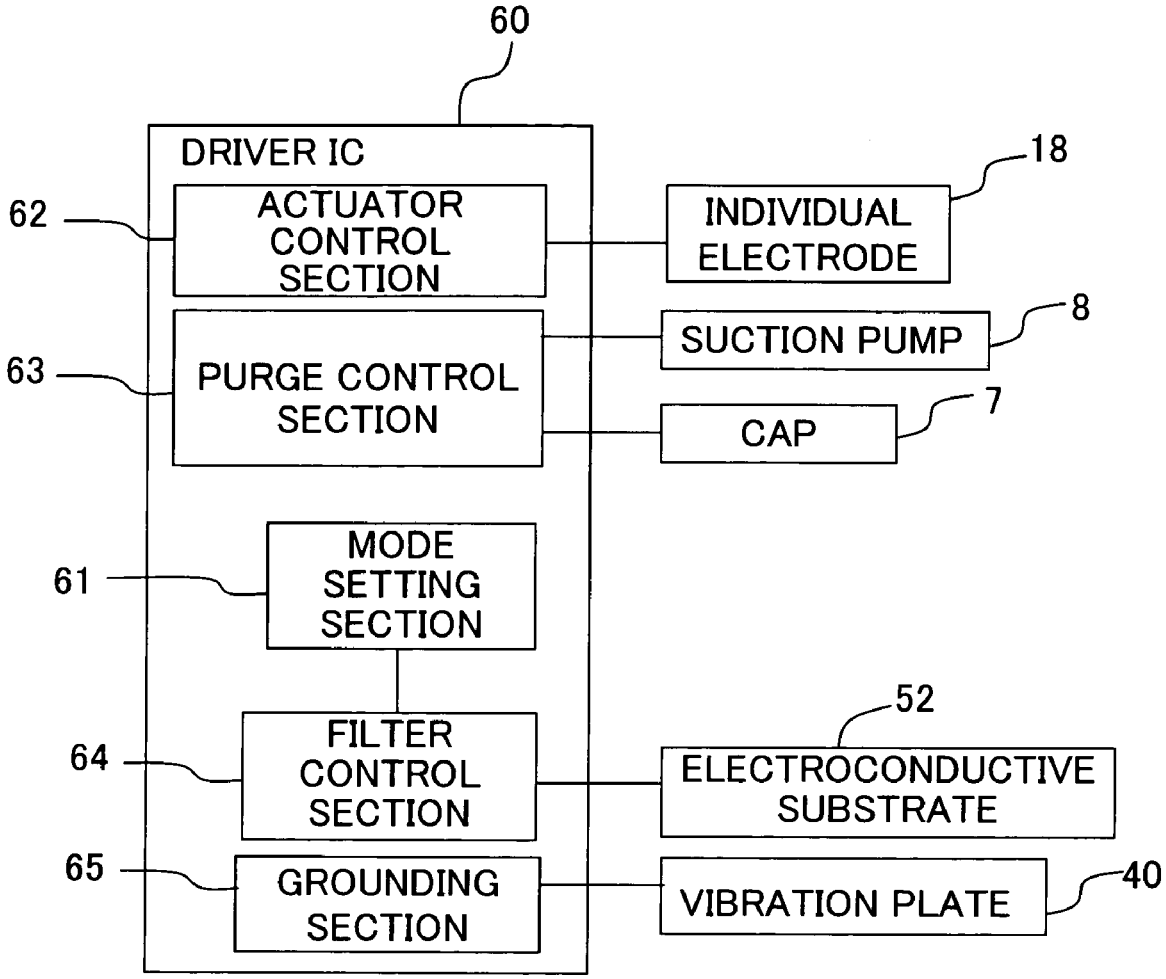
FIG. 6 is a block diagram of a driver IC which controls an operation of the ink-jet recording apparatus in FIG. 1.

Next, the driver IC 60 will be explained below by using FIG. 6. FIG. 6 is a block diagram of the driver IC 60. The driver IC 60 controls each operation of the ink-jet recording apparatus 1. As shown in FIG. 6, the driver IC 60 includes a mode setting section 61, an actuator control section 62, a purge control section 63, a filter control section 64, and a grounding section 65.

The actuator control section 62 controls an electric potential of the individual electrodes 18 and controls an operation of the piezoelectric actuator 32 when performing recording on the recording paper P by discharging ink from the nozzles 17. The purge control section 63 controls an operation of the cap 7 and the suction pump 8 when performing purge for removing a foreign matter and/or an air bubble in the individual ink channel and/or the manifold channel 11.

The mode setting section 61 is selectively set to an air bubble trapping mode for trapping the air bubble in the filter 13 to prevent the air bubble from flowing into the manifold channel 11 and the individual ink channels, and to an air bubble releasing mode for releasing the air bubble trapped in the filter 13. Here, at the time of a purge operation which will be described later, the mode setting section 61 is set to the air bubble releasing mode, in conjunction with the purge control section 63. Further, after the completion of the purge operation, the mode setting section 61 is set to the air bubble trapping mode, in conjunction with the purge control section 63. Thus, since the mode setting section 61 and the purge control section 63 are mutually in conjunction, the air bubble adhered to the surface of the filter 13 can be released and sucked assuredly at the time of purge.

The filter control section 64 controls the electric potential of the electroconductive substrate 52 of the filter 13 according to the mode to which the mode setting section 61 is set. Specifically, when the mode setting section 61 is set to the air bubble trapping mode, the filter control section 64 allows the electric potential of the electroconductive substrate 52 to be the ground potential. On the other hand, when the mode setting section 61 is set to the air bubble releasing mode, the filter control section 64 allows the electric potential of the electroconductive substrate 52 to be a predetermined electric potential (electric potential different from a reference electric potential) which is higher than the ground potential. The grounding section 65 keeps (maintains) the vibration plate 40 at the ground potential. The predetermined electric potential is an electric potential which is sufficient for drawing (separating) the air bubble apart (away) from the surface of the insulating layer 53 by improving (increasing) the wettability of the surface of the insulating layer 53 by the electrowetting phenomenon, at the time of purge.

Figure 8A:
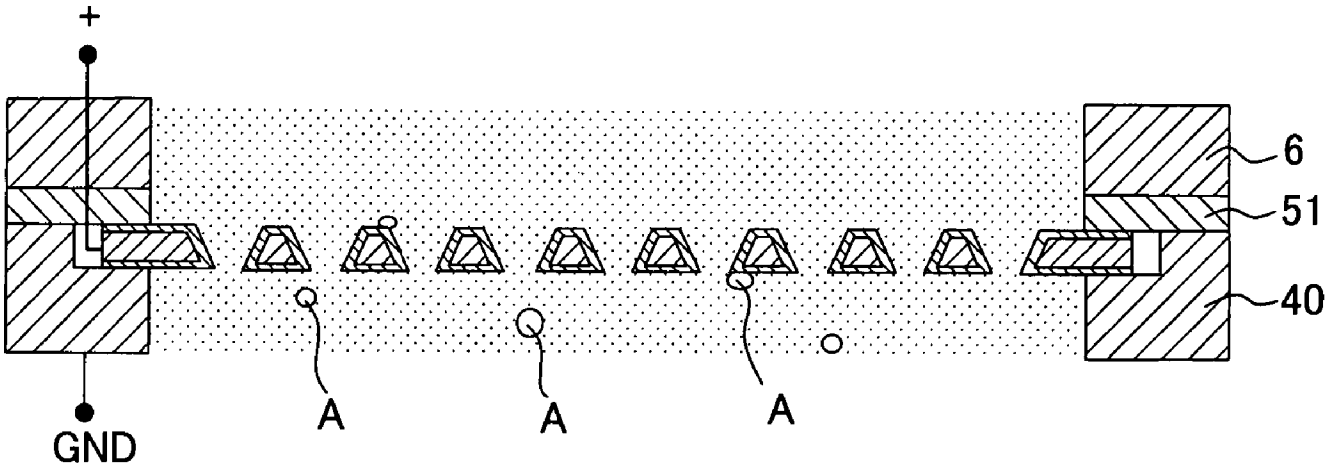
FIG. 8A is a diagram showing a state when a purge is performed in the ink-jet head in FIG. 2.
Figure 8B:
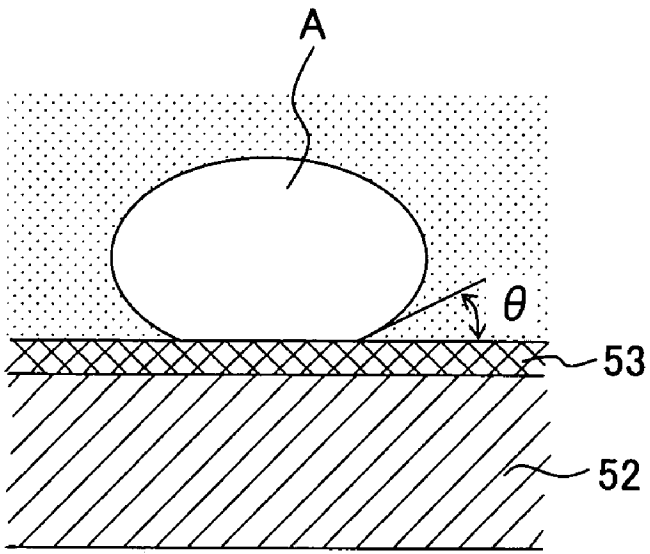
FIG. 8B is a diagram in which a surface of the filter in FIG. 8A is enlarged.

Next, a recording operation and a purge operation in the ink-jet recording apparatus 1 will be described by using FIGS. 7A, 7B, 8A, and 8B. FIG. 7A is a diagram showing a state at the time of recording in the ink-jet recording apparatus 1, and FIG. 7B is a diagram in which the surface of the filter 13 in FIG. 7A is enlarged. FIG. 8A is a diagram showing a state at the time of purge in the ink-jet recording apparatus 1, and FIG. 8B is a diagram in which the surface of the filter 13 in FIG. 8A is enlarged. A "+" sign in FIG. 8A indicates that the electric potential is a predetermined electric potential which is higher than the ground potential, and "GND" in FIG. 8A indicates that the electric potential is the ground potential.

Firstly, the operation at the time of recording in the ink-jet recording apparatus 1 will be explained. At the time of recording, the mode setting section 61 of the driver IC 60 is set to the air bubble trapping mode. At this time, the filter control section 64 controls the electric potential of the electroconductive substrate 52, thereby making the electric potential of the electroconductive substrate 52 to be the ground potential as shown in FIG. 7A. Accordingly, the electroconductive substrate 52 and the ink in the ink supply channel have a same electric potential. In this case, due to reasons mentioned earlier, since the wettability of the surface of the insulating layer 53 arranged between the ink and the electroconductive substrate 52 is low (wetting angle θ is about 70°, for example) as it has been, air bubbles A in the ink easily adhere to the surface of the insulating layer 53.

Then, the actuator control section 62 selectively controls the electric potential of a desired individual electrode 18 of the individual electrodes 18, so that the desired individual electrode 18 is made to have a predetermined positive electric potential. At this time, a difference occurs between the electric potential of the vibration plate 40 serving as the common electrode which is kept at the ground potential and the electric potential of the selected individual electrode 18. Accordingly, an electric field in a direction of thickness of the piezoelectric layer 41 is generated in a portion of the piezoelectric layer 41 sandwiched between the individual electrode 18 and the vibration plate 40. At this time, when a direction in which the piezoelectric layer 41 is polarized and the direction of the electric field are the same, the piezoelectric layer 41 is contracted in a horizontal direction which is orthogonal to the direction of thickness that is the direction in which the piezoelectric layer 41 is polarized. With the contraction of the piezoelectric layer 41, the vibration plate 40 is deformed to project toward the pressure chamber 10. At this time, at first, a volume inside the pressure chamber 10 is decreased and then a pressure is applied to the ink in the pressure chamber 10, thereby discharging the ink from the nozzle 17 which communicates with the pressure chamber 10.

When the ink is discharged, in the filter 13, since an air bubble or bubbles A in the ink is in a state that the air bubble A easily adheres to the surface of the insulating layer 53, the foreign matter and/or the air bubble A in the ink are/is trapped on the surface of the insulating layer 53, and the foreign matter and/or the air bubble A are/is prevented from flowing into the manifold channel 11. Accordingly, it is possible to prevent the decline in recording quality which would be otherwise caused by a variation in the pressure of the ink in the pressure chamber 10 and by a clog-up of the nozzle 17 due to the foreign matter and/or the air bubble A. Furthermore, since the minimum diameter of the through hole 13*a* of the filter 13 is smaller than the minimum diameter of the nozzle 17, the foreign matter and/or the air bubble having a size greater than the diameter of the nozzle 17 is/are assuredly prevented from flowing into the manifold channel 11 and the individual ink channels.

Next, the purge operation in the ink-jet recording apparatus 1 will be explained below. At the time of purge, the mode setting section (mode indicating section) 61 of the driver IC 60 is set to the air bubble releasing mode. This air bubble releasing mode is either set according to a button operation by a user, or is set automatically when a predetermined time is elapsed without the discharge of the ink (no predetermined positive electric potential is applied to the individual electrodes 18) from the nozzles 17 in a state that the mode setting section 61 is set to the air bubble trapping mode. At this time, the filter control section 64 controls the electric potential of the electroconductive substrate 52, and allows the electric potential of the electroconductive substrate 52 to be a predetermined electric potential which is higher than the ground potential. Accordingly, an electric potential difference is developed between the electroconductive substrate 52 of the filter 13 and the ink in the ink supply channel. Therefore, the wettability on the surface of the insulating layer 53, which is arranged between the electroconductive substrate 52 and the ink, is increased (wetting angle is about 40°, for example) (electrowetting phenomenon) and the air bubble A in the ink is hardly adhered to the surface of the insulating layer 53.

Further, based on the control from the purge control section 63, the cap 7 makes a contact with the ink discharge surface 23*a*, and by driving the suction pump 8 in a state that the cap 7 is in contact with the ink discharge surface 23*a*, the ink in the individual ink channels and the ink supply channel is sucked from a side of the cap 7, and the purge is performed.

At the time of purge, since the surface of the insulating layer 53 of the filter 13 is in a state in which the air bubble is hardly adhered to the surface of the insulating layer 53, the air bubble A in the ink adhered to the surface of the insulating layer 53 of the filter 13 is drawn apart (separated away) from the surface of the insulating layer 53 of the filter 13, and moves through the ink supply channel and the individual ink channel to be discharged from the nozzle 17. Thus, since the air bubble A adhered to the surface of the filter 13 is discharged by performing the purge, it is possible to prevent of the air bubble A from remaining in the through hole 13*a* of the filter 13, and thus to prevent the occurrence of clog-up of the filter 13 which would be otherwise caused by the air bubble A.

According to the embodiment described above, at the time of recording in the ink-jet recording apparatus 1, the mode setting section 61 of the driver IC 60 is set to the air bubble trapping mode, and the electric potential of the electroconductive substrate 52 of the filter 13 becomes the ground potential. At this time, the wettability on the surface of the insulating layer 53 is still low as it has been, and the air bubble in the ink easily adheres to the surface of the filter 13. Consequently, at the time of recording, the air bubble in the ink can be trapped assuredly in the filter 13, and the air bubble can be prevented from flowing into the manifold channel 11. Accordingly, the clog-up of the nozzle 17 due to the air bubble is prevented, and thus the decline in the recording quality, which would be otherwise caused by improper ink discharge from the nozzle 17 due to the air bubble flowing into the individual ink channel, is prevented.

Further, at the time of purge in the ink-jet recording apparatus 1, the mode setting section 61 of the driver IC 60 is set to the air bubble releasing mode, and the electric potential of the electroconductive substrate 52 of the filter 13 becomes a predetermined electric potential which is higher than the ground potential. Due to the electrowetting effect mentioned above, the wettability on the surface of the insulating layer 53 is increased (becomes high), and the air bubble is hardly adhered to the surface of the insulating layer 53 of the filter 13. Consequently, when the purge is performed, the air bubble is prevented from remaining on the surface of the insulating layer 53 of the filter 13. Accordingly, it is possible to prevent the clog-up of the filter 13 due to the air bubble remained in the filter 13.

Further, the filter 13 has a structure in which the insulating layer 53 is formed on the surface of the electroconductive substrate 52 which is made of a metallic material and in which the through holes 13*a* are formed. Therefore, the filter 13 can be manufactured easily by forming the through holes 13*a* in the metallic electroconductive substrate 52 by a method such as the electroforming or the press working, and by forming the insulating layer 53 on the surface of the electroconductive substrate 52 by a method such as the CVD method.

Furthermore, since the ink in the ink supply channel is in contact with the vibration plate 40 which is kept at the ground potential, the ink is kept at the ground potential. When the electric potential of the electroconductive substrate 52 is set to the predetermined electric potential, the electric potential difference is developed assuredly between the electroconductive substrate 52 and the ink in the ink supply channel. Therefore, the wettability of the surface of the insulating layer 53 can be increased assuredly. Further, there is no need to provide any separate electrode in the ink supply channel for keeping the ink at the ground potential, and thus the structure of the ink-jet recording apparatus becomes simple.

The channel area of each of the through holes 13*a* of the filter 13 decreases toward the manifold channel 11. Therefore, the reverse flow of ink from the manifold channel 11 to the ink supply channel is prevented. Furthermore, since the minimum diameter of the through hole 13*a* is smaller than the diameter of the ink discharge port 17*a* of the nozzle 17, the foreign matter and/or the air bubble in the ink having a size greater than the diameter of the ink discharge port 17*a* can be removed assuredly in the filter 13, and the clog-up of the nozzle 17 can be prevented even more assuredly.

Further, since the through holes 13*a* of the filter 13 are distributed uniformly in the electroconductive substrate 52, the foreign matter and/or the air bubble in the ink can be trapped efficiently in the filter 13.

Next, modified embodiments in which various changes are made to the embodiment will be explained. Same reference numerals will be given to parts or components having similar construction as those in the embodiment, and explanation therefor will be omitted as appropriate.

First Modified Embodiment

Figure 9:
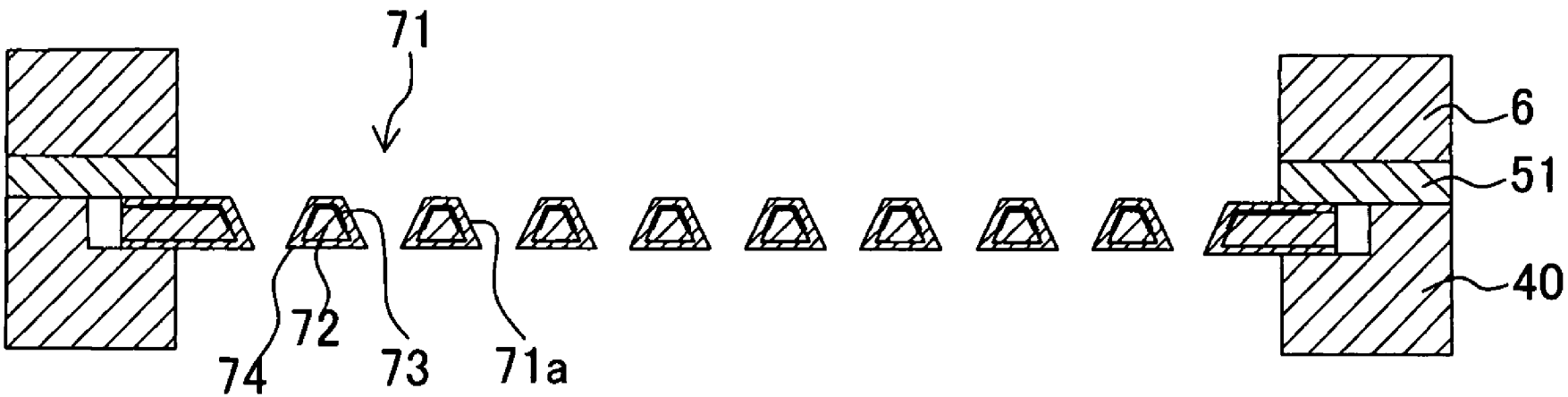
FIG. 9 is a cross-sectional view of a first modified embodiment, corresponding to FIG. 5.

The filter is not limited to a filter in which an insulating layer is formed on a surface of an electroconductive substrate formed with a plurality of through holes. As shown in FIG. 9, a filter 71 may include an insulating member 72 in which a plurality of through holes 71*a* are formed, electrodes 73 which are made of a metallic material and each of which is formed on a surface of the insulating member 72 on a side opposite to the manifold channel 11, and on an inner surface which defines one of the through holes 71*a*, and an insulating layer 74 which is formed on surfaces of the electrodes 73. Here, the insulating member 72 and the insulating layer 74 are formed of an insulating material such as a fluororesin. However, the insulating member 72 and the insulating layer 74 may be formed of a same material or may be formed of different materials. Further, the electrodes 73 are connected to the driver IC 60 by a wiring which is not shown in the diagram.

In this case also, when the electrode 73 is at the ground potential, since the wettability on a surface of the insulating layer 74 is still low as has been, the air bubble easily adheres onto a surface of the filter 71. When the electric potential of the electrodes 73 becomes a predetermined potential, the wettability of a portion of the insulating layer 74 facing the electrodes 73, in other words, the wettability of a surface of the filter 71 on a side opposite to the manifold channel 11, and of the inner surface (of the filter 71) which defines each of the through holes 71*a* is increased, and the air bubble is hardly adhered to this portion. Consequently, the air bubble can be trapped assuredly on the surface of the filter 71 at the time of recording, and the air bubble adhered to the through holes 71*a* can be discharged assuredly at the time of purge. Further, after forming the through holes 71*a* in the insulating member 72 by irradiating a beam such as an excimer laser beams, such a filter 71 can be manufactured by forming the electrodes 73 by a method such as the vapor deposition, on a predetermined surface, namely a surface which is arranged on the side opposite to the manifold channel 11, and on the inner surface which defines each of the through holes 71*a*; and further by forming the insulating layer 74 on the surface on which the electrode 73 is formed, by a method similar to the method used in the embodiment. Accordingly, the through holes 71*a* can be formed with high precision by irradiating a beam such as the excimer laser beam.

Second Modified Embodiment

Figure 10:
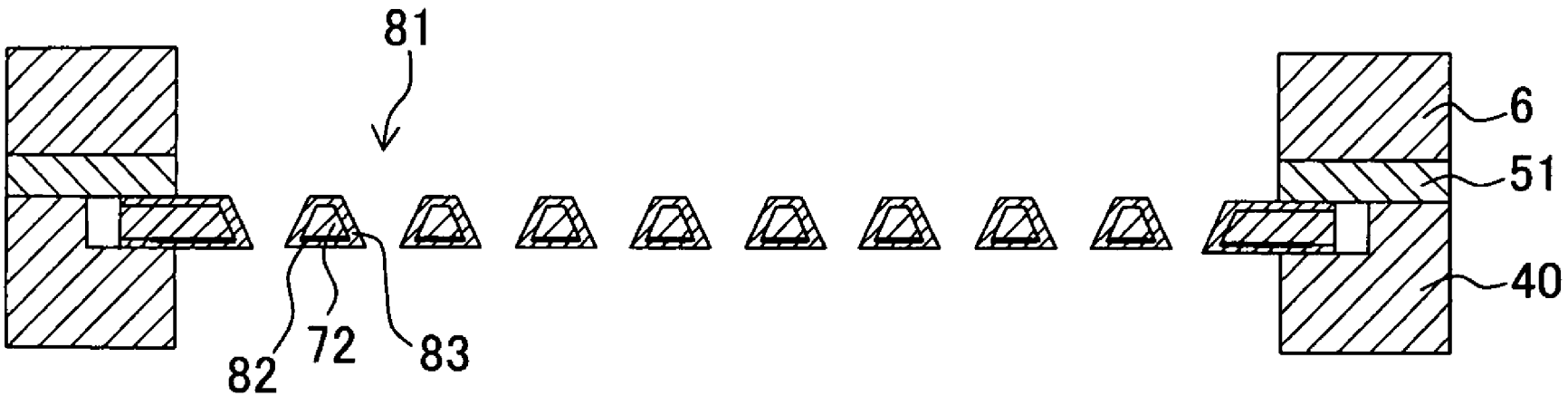
FIG. 10 is a cross-sectional view of a second modified embodiment, corresponding to FIG. 5.

Further, as in a filter 81 shown in FIG. 10, electrodes 82 may be formed on a surface of the insulating member 72 which is flat, the surface being on the side of the manifold channel 11, and an insulating layer 83 may be formed to cover the entire insulating member 72 from the upper side. In this case, since the surface on which the electrodes 82 are formed is a flat surface, the electrodes 82 can be formed easily.

Third Modified Embodiment

Figure 11A:
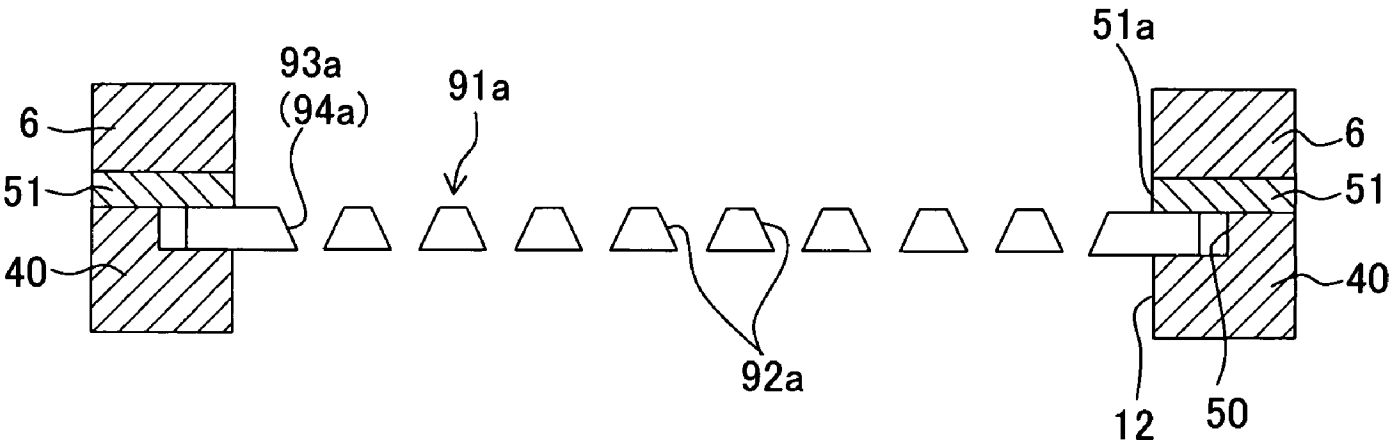
FIG. 11A is a cross-sectional view of a third modified embodiment, corresponding to FIG. 5.
Figure 11B:
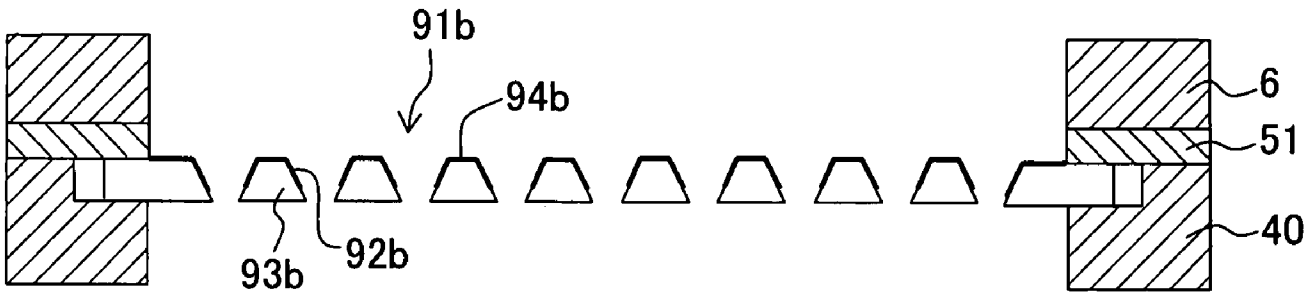
FIG. 11B is a cross-sectional view of the third modified embodiment, corresponding to FIG. 9.

Any insulating layer may not be formed on surfaces of the electrodes of the filter. For example, a filter 91*a* shown in FIG. 11A includes an electroconductive substrate 93*a* in which a plurality of through holes 92*a* is formed. Further, the electroconductive substrate 93*a* also serves as an electrode 94*a*. Here, the filter 91*a* has a same structure as the structure of the filter 13 in the embodiment, except that no insulating layer is formed on the surface of the filter 91*a*. Or, a filter 91*b* shown in FIG. 11B includes a substrate 93*b* which is electroconductive and in which a plurality of through holes 92*b* are formed; and electrodes 94*b* made of a metallic material and each formed on an inner surface of the substrate 93*b* which defines (forms) one of the through holes 92*b*, and on a surface of the substrate 93*b*. Here, the filter 91*b* has a structure similar to the structure of the filter 71 in the first modified embodiment except that no insulating layer is formed on surfaces of the electrodes 94*b*. In any of the cases, the electrodes 94*a*, 94*b* are connected to the driver IC 60 via a wiring which is not shown in the diagram. Generally, even when the insulating layer is not formed on a surface of a metallic member, it is known that the wettability of the surface of the metallic member is lowered by applying voltage between an electroconductive liquid and the metallic member, and this phenomenon is also considered to be a type of the electrowetting phenomenon. Consequently, even in the filters 91*a*, 91*b* of the third modified embodiment, similarly as in the embodiment, in a case of causing the air bubble to adhere to the electrodes 94*a* and 94*b* of the filters 91*a* and 91*b* respectively, the electrodes 94*a*, 94*b* and the ink are set to be at the same electric potential, and in a case of causing to release the air bubble adhered to the filter 91*a*, 91*b*, a predetermined voltage is applied between the electrodes 94*a*, 94*b* and the ink. The filters 91*a*, 91*b* are insulated from the vibration plate 40 and the fixed member 51, by an insulating member which is not shown in the diagram.

Further, in the embodiment of the present invention, the ink in the ink supply channel is kept at the ground potential by the vibration plate 40. However, a separate electrode which is kept at the ground potential may be provided inside the ink supply channel.

Furthermore, when the mode setting section 61 is set to the air bubble releasing mode, the control may be performed such that the electric potential of the electroconductive substrate 52 becomes a predetermined electric potential lower than the ground potential which is the reference electric potential. The predetermined electric potential in this case also is an electric potential sufficient for the wettability of the surface of the insulating layer 53 to be improved by the electrowetting phenomenon, and for the air bubble to be drawn apart (be separated away) from the insulating layer 53 at the time of purge.

Further, the shape of the through holes 13*a* is not limited to a case in which the channel area of each of the through holes 13*a* is decreased toward the manifold channel 11. For example, the through holes 13*a* may be formed such that each of the through holes 13*a* may be formed to be perpendicular to the surface of the electroconductive substrate 52, and the channel area of the through hole 13*a* is constant.

Further, the through holes may not be formed to be distributed uniformly in the electroconductive substrate 52*a*. Instead, the through holes 13*a* may be formed such that the through holes 13*a* are distributed uniformly only in a portion or part of the electroconductive substrate 52.

Furthermore, it is not necessarily indispensable that the through holes 13*a* are formed to be circular shaped in a plan view. Rather, the through holes 13*a* may be formed, in a plan view, to be oval shaped, elliptical shaped, and polygonal shaped, or the like. Moreover, the ink discharge ports 17*a* may also be formed, in a plan view, to be oval shaped, elliptical shaped, and polygonal shaped, or the like. In this case, by forming the through hole 13*a* to have the minimum diameter (diameter of an inscribed circle in a plan-viewed shape of the through hole 13*a* when the through holes 13*a* are not formed to be circular shaped in a plan view) to be smaller than the diameter of the ink discharge port 17*a* (diameter of a circle inscribed in the ink discharge port when the shape of the discharge port is not circular), then similarly as in the embodiment described above, the foreign matter and/or the air bubble stagnated without passing through the ink discharge port 17*a* can be removed assuredly, and the clog-up of the ink discharge port 17*a* can be prevented assuredly.

A location at which the filter is arranged is not limited to the location at which the filter is arranged in the embodiment. The filter can be arranged at any position in a channel through which the ink flows, such as the ink channel formed in the channel unit or the tube connecting the ink tank and the channel unit. Further, the diameter and shape of the through hole formed in the filter can be set voluntarily.

In addition to the ink-jet recording apparatus, the present invention is also applicable to a liquid transporting apparatus which transports a liquid other than the ink, such as a reagent, a biomedical solution, a wiring material solution, an electronic material solution, a cooling medium, and a fuel.

What is claimed is:

1. An air bubble trapping apparatus which traps an air bubble present in a liquid flowing through a liquid channel, the air bubble trapping apparatus comprising:

a filter arranged in the liquid channel and including a substrate having an electroconductive area formed in a surface of the substrate at a region at which a plurality of through holes are formed through the electroconductive area of the substrate and through which the liquid passes;

an electric potential control mechanism which controls an electric potential of the electroconductive area of the substrate; and a mode setting unit which is selectively settable to an air bubble trapping mode for trapping the air bubble in the liquid on a surface of the filter, and an air bubble releasing mode for releasing the air bubble trapped on the surface of the filter, wherein the electric potential control mechanism controls the electric potential of the electroconductive area such that an absolute value of a difference between the electric potential of the electroconductive area and an electric potential of the liquid flowing through the liquid channel when the mode setting unit is set to the air bubble trapping mode is smaller than an absolute value of a difference between the electric potential of the electroconductive area and the electric potential of the liquid flowing through the liquid channel when the mode setting unit is set to the air bubble releasing mode, and wherein the filter further comprises an insulating layer which is stacked in laminate on the substrate and which covers the electroconductive area of the substrate, such that the electroconductive area is electrically insulated from the liquid.

2. The air bubble trapping apparatus according to claim 1, wherein the liquid is an electroconductive liquid flowing through the liquid channel; and the filter traps the air bubble present in the electroconductive liquid.

3. The air bubble trapping apparatus according to claim 1, further comprising a constant potential maintaining mechanism which maintains the electric potential of the liquid flowing through the liquid channel at a predetermined reference electric potential.

4. The air bubble trapping apparatus according to claim 3, wherein the liquid channel is formed by a channel member which includes an electroconductive material; and the constant potential maintaining mechanism includes a grounding mechanism which grounds the channel member.

5. The air bubble trapping apparatus according to claim 3, wherein the electric potential control mechanism controls the electric potential of the electroconductive area such that an absolute value of a difference between the electric potential of the electroconductive area and the reference electric potential when the mode setting unit is set to the air bubble releasing mode is greater than an absolute value of a difference between the electric potential of the electroconductive area and the reference electric potential when the mode setting unit set to the air bubble trapping mode.

6. The air bubble trapping apparatus according to claim 3, wherein the electric potential control mechanism controls the electric potential of the electroconductive area such that the electric potential of the electroconductive area and the reference electric potential are same when the mode setting unit is set to the air bubble trapping mode, and such that the electric potential of the electroconductive area differs from the reference electric potential when the mode setting unit is set to the air bubble releasing mode.

7. The air bubble trapping apparatus according to claim 1, wherein the substrate is formed of a metallic material.

8. The air bubble trapping apparatus according to claim 1, wherein the substrate includes an insulating member in which the through holes are formed; and an electrode which is formed on a surface of the insulating member and which forms the electroconductive area.

9. The air bubble trapping apparatus according to claim 8, wherein the electrode is formed on a surface which defines each of the through holes formed in the insulating member.

10. The air bubble trapping apparatus according to claim 9, wherein the surface of the insulating layer is flat, and the electrode is formed on the surface of the insulating member which is flat.

11. The air bubble trapping apparatus according to claim 1, wherein a cross-sectional area of each of the through holes is decreasing toward one side in a direction in which each of the through holes is extended.

12. The air bubble trapping apparatus according to claim 1, wherein the through holes are formed in the substrate so that the through holes are distributed uniformly in the surface of the substrate.

13. The air bubble trapping apparatus according to claim 1, wherein the insulating layer is formed of a fluororesin.

14. The air bubble trapping apparatus according to claim 1, wherein the air bubble trapping apparatus is disposed within a liquid discharging apparatus which discharges the liquid, wherein the liquid discharging apparatus comprises:

a liquid supply source which supplies the liquid;

a plurality of liquid discharge ports;

a common liquid chamber which communicates with the liquid discharge ports;

a plurality of individual liquid transport channels each of which communicates with the common liquid chamber and one of the liquid discharge ports; and an energy imparting mechanism which is provided corresponding to each of the individual liquid transport channels, and which imparts discharge energy to the liquid, and wherein the liquid channel supplies the liquid from the liquid supply source to the common liquid chamber.

15. The air bubble trapping apparatus according to claim 14, wherein the filter includes an insulating layer which covers the electroconductive area of the substrate.

16. The air bubble trapping apparatus according to claim 14, wherein the liquid discharging apparatus further comprises:

a purge mechanism which includes a suction pump which sucks the liquid and the air bubble, and a cap which covers the liquid discharge ports; and a purge control unit configured to control an operation of the purge mechanism;

wherein the mode setting unit is configured to set to the air bubble releasing mode when the purge control unit controls the purge mechanism to perform purge.

17. The air bubble trapping apparatus according to claim 16, wherein the mode setting unit is configured to set to the air bubble trapping mode when the purge control unit controls the purge mechanism to complete the purge.

18. The air bubble trapping apparatus according to claim 14, wherein a minimum diameter of an inscribed circle accommodatable in each of the through holes is smaller than a diameter of an inscribed circle accommodatable in each of the discharge port.

19. A liquid transporting apparatus comprising:

a liquid channel through which a liquid flows; and the air bubble trapping apparatus as defined in claim 1.

20. An ink jet recording apparatus which discharges an ink, comprising:

an ink supply source which supplies the ink;

a plurality of ink discharge ports;

a common liquid chamber which communicates with the ink discharge ports;

a plurality of individual ink channels each of which communicates with the common liquid chamber and one of the ink discharge ports;

an energy imparting mechanism which is provided corresponding to each of the individual ink channels, and which imparts discharge energy to the ink;

an ink supply channel which supplies the ink from the ink supply source to the common liquid chamber;

a filter arranged inside the ink supply channel and including a substrate having an electroconductive area formed in a surface of the substrate at a region at which a plurality of through holes are formed through the electroconductive area of the substrate and through which the ink passes;

an electric potential control mechanism which controls an electric potential of the electroconductive area of the filter; and a mode setting unit which is selectively settable to an air bubble trapping mode for trapping the air bubble in the ink on a surface of the filter, and an air bubble releasing mode for releasing the air bubble trapped on the surface of the filter, wherein the electric potential control mechanism controls the electric potential of the electroconductive area such that an absolute value of a difference between the electric potential of the electroconductive area and an electric potential of the ink flowing through the ink supply channel when the mode setting unit is set to the air bubble trapping mode is smaller than an absolute value of a difference between the electric potential of the electroconductive area and the electric potential of the ink flowing through the ink supply channel when the mode setting unit is set to the air bubble releasing mode, and wherein the filter comprises an insulating layer which is stacked in laminate on the substrate and which covers the electroconductive area of the substrate, such that the electroconductive area is electrically insulated from the ink.

21. The ink jet recording apparatus according to claim 20, further comprising:

a purge mechanism which includes a suction pump which sucks the ink and the air bubble, and a cap which covers the ink discharge ports; and a purge control unit configured to control an operation of the purge mechanism;

wherein the mode setting unit is configured to set to the air bubble releasing mode when the purge control unit controls the purge mechanism to perform purge.

22. The ink jet recording apparatus according to claim 21, wherein the mode setting unit is configured to set to the air bubble trapping mode when the purge control unit controls the purge mechanism to complete the purge.

23. The ink jet recording apparatus according to claim 20, wherein a minimum diameter of an inscribed circle accommodatable in each of the through holes is smaller than a diameter of an inscribed circle accommodatable in each of the discharge port.

* * * * *